US008561521B2

(12) United States Patent
Kang et al.

(10) Patent No.: US 8,561,521 B2
(45) Date of Patent: Oct. 22, 2013

(54) LINEAR COMPRESSOR

(75) Inventors: Yang-Jun Kang, Changwon-shi (KR); Young-Hoan Jeon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 751 days.

(21) Appl. No.: 12/452,858

(22) PCT Filed: Jul. 28, 2008

(86) PCT No.: PCT/KR2008/004395
§ 371 (c)(1),
(2), (4) Date: Feb. 23, 2010

(87) PCT Pub. No.: WO2009/017347
PCT Pub. Date: Feb. 5, 2009

(65) Prior Publication Data

US 2012/0024148 A1 Feb. 2, 2012

(30) Foreign Application Priority Data

Jul. 27, 2007 (KR) ..... 10-2007-0075932
Jul. 27, 2007 (KR) ..... 10-2007-0075933
Jul. 27, 2007 (KR) ..... 10-2007-0075934

(51) Int. Cl.
*F01B 31/00* (2006.01)

(52) U.S. Cl.
USPC ..... 92/130 C; 92/130 D; 92/161

(58) Field of Classification Search
USPC ..... 92/161, 130 C, 130 D; 417/417, 312
See application file for complete search history.

(56) References Cited

U.S. PATENT DOCUMENTS

| | | | | |
|---|---|---|---|---|
| 4,477,229 | A * | 10/1984 | Kropiwnicki et al. | 417/53 |
| 5,993,178 | A * | 11/1999 | Park et al. | 417/545 |
| 6,413,057 | B1 * | 7/2002 | Hong et al. | 417/416 |
| 6,881,042 | B2 | 4/2005 | Heo et al. | |
| 7,566,206 | B2 * | 7/2009 | Lee et al. | 417/258 |
| 2003/0017064 | A1 | 1/2003 | Kawahara et al. | |
| 2003/0095879 | A1 | 5/2003 | Oh et al. | |
| 2005/0098031 | A1 * | 5/2005 | Yoon et al. | 92/84 |
| 2005/0123422 | A1 * | 6/2005 | Lilie | 417/416 |
| 2006/0078443 | A1 | 4/2006 | Noh et al. | |

(Continued)

FOREIGN PATENT DOCUMENTS

| | | | |
|---|---|---|---|
| CN | 1103870 | C | 3/2003 |
| CN | 1174168 | C | 11/2004 |

(Continued)

*Primary Examiner* — Edward Look
*Assistant Examiner* — Michael Quandt
(74) *Attorney, Agent, or Firm* — McKenna Long & Aldridge LLP

(57) ABSTRACT

There is provided a linear compressor, which can reduce parts production costs and simplify a part installation process by decreasing the number of main springs. The linear compressor comprises: a cylinder providing a space for compressing a refrigerant; a piston linearly reciprocating inside the cylinder to compress the refrigerant; an inner stator; an outer stator; a permanent magnet connected to the piston and linearly reciprocating between the inner stator and the outer stator; a supporter piston connected to the piston, at least part thereof being extended in a radial direction of the piston; a plurality of front main springs positioned on the same axis as the piston, one ends of which being supported by the supporter piston; and one rear main spring positioned on the opposite side of the piston, one end of which being supported by the supporter piston.

19 Claims, 5 Drawing Sheets

(56) References Cited

U.S. PATENT DOCUMENTS

| | | | | |
|---|---|---|---|---|
| 2006/0091735 | A1* | 5/2006 | Song et al. | 310/12 |
| 2006/0093495 | A1 | 5/2006 | Oh et al. | |
| 2006/0280630 | A1* | 12/2006 | Lee et al. | 417/417 |
| 2007/0104597 | A1* | 5/2007 | Park et al. | 417/417 |
| 2009/0208347 | A1* | 8/2009 | Heo | 417/44.1 |

FOREIGN PATENT DOCUMENTS

| | | | |
|---|---|---|---|
| CN | 1243914 | C | 3/2006 |
| CN | 1759244 | A | 4/2006 |
| CN | 1769680 | A | 5/2006 |
| DE | 10 2005 005 698 | A1 | 5/2006 |
| DE | 10 2005 047 121 | A1 | 11/2006 |
| KR | 10-2001-0064578 | | 7/2001 |
| KR | 10-2006-0025109 | | 3/2006 |
| KR | 10-2007-0075907 | | 7/2007 |
| KR | 10-2007-0075913 | | 7/2007 |
| WO | WO 2004/081421 | A2 | 9/2004 |

* cited by examiner

LINEAR COMPRESSOR

This application is a National Phase entry of PCT Application No. PCT/KR2008/004395, filed Jul. 28, 2008, and claims the benefit of Korean Patent Application No. 10-2007-0075932, filed Jul. 27, 2007, Korean Patent Application No. 10-2007-0075933, filed Jul. 27, 2007 and Korean Patent Application No. 10-2007-0075934, filed Jul. 27, 2007, the above-identified applications are incorporated by reference herein in their entireties.

TECHNICAL FIELD

The present invention relates to a linear compressor, and more particularly, to a linear compressor, which includes three main springs having a resonance frequency set to the operating frequency of the linear compressor and can adjust the resonance frequency by an added mass.

BACKGROUND ART

In general, a compressor is a mechanical apparatus for compressing the air, refrigerant or other various operation gases and raising a pressure thereof, by receiving power from a power generation apparatus such as an electric motor or turbine. The compressor has been widely used for an electric home appliance such as a refrigerator and an air conditioner, or in the whole industry.

The compressors are roughly classified into a reciprocating compressor in which a compression space for sucking or discharging an operation gas is formed between a piston and a cylinder, and the piston is linearly reciprocated inside the cylinder, for compressing a refrigerant, a rotary compressor in which a compression space for sucking or discharging an operation gas is formed between an eccentrically-rotated roller and a cylinder, and the roller is eccentrically rotated along the inner wall of the cylinder, for compressing a refrigerant, and a scroll compressor in which a compression space for sucking or discharging an operation gas is formed between an orbiting scroll and a fixed scroll, and the orbiting scroll is rotated along the fixed scroll, for compressing a refrigerant.

Recently, a linear compressor which can improve compression efficiency and simplify the whole structure without a mechanical loss resulting from motion conversion by connecting a piston directly to a linearly-reciprocated driving motor has been popularly developed among the reciprocating compressors.

FIG. 1 is a view illustrating a conventional linear compressor. FIG. 2 is a view illustrating the linear compressor of FIG. 1 as viewed from the back cover. In the linear compressor 1, the piston 30 is linearly reciprocated in a cylinder 20 by a linear motor 40 inside a hermetic shell 10, for sucking, compressing and discharging a refrigerant. The linear motor 40 includes an inner stator 42, an outer stator 44, and a permanent magnet 46 disposed between the inner stator 42 and the outer stator 44, and linearly reciprocated by a mutual electromagnetic force. As the permanent magnet 46 is driven in a state where it is coupled to the piston 30, the piston 30 is reciprocated linearly inside the cylinder 20 to suck, compress and discharge the refrigerant.

The linear compressor 1 further includes a frame 52, a stator cover 54, and a back cover 56. The linear compressor may have a configuration in which the cylinder 20 is fixed by the frame 20, or a a configuration in which the cylinder 20 and the frame 52 are integrally formed. At the front of the cylinder 20, a discharge valve 62 is elastically supported by an elastic member, and selectively opened and closed according to the pressure of the refrigerant inside the cylinder. A discharge cap 64 and a discharge muffler 66 are installed at the front of the discharge valve 62, and the discharge cap 64 and the discharge muffler 66 are fixed to the frame 52. One end of the inner stator 42 or outer stator 44 as well is supported by the frame 52, and an O-ring or the like of the inner stator 42 is supported by a separate member or a projection formed on the cylinder 20, and the other end of the outer stator 44 is supported by the stator cover 54. The back cover 56 is installed on the stator cover 54, and a muffler 70 is positioned between the back cover 56 and the stator cover 54.

Further, a supporter piston 32 is coupled to the rear of the piston 30. Main springs 80 whose natural frequency is adjusted are installed at the supporter piston 32 so that the piston 30 can be resonantly moved. The main springs 80 are divided into front springs 82 whose both ends are supported by the supporter piston 32 and the stator cover 54 and rear springs 84 whose both ends are supported by the supporter piston 32 and the back cover 56. The conventional linear compressor includes four front springs 82 and four rear springs 84 at longitudinally and laterally symmetrical positions. Accordingly, the number of main springs 82 to be provided and the positional parameters to be controlled in order to maintain balance upon movement of the piston 30 are eight, respectively. Consequently, the manufacturing process becomes complicated and longer and the manufacturing cost is high due to a large quantity of main springs and a large number of parameters to be controlled.

DISCLOSURE OF INVENTION

Technical Problem

It is an object of the present invention to provide a linear compressor, which can reduce parts, production costs and simplify a part installation process by decreasing the number of main springs.

It is another object of the present invention to provide a linear compressor, which comprises one rear main spring and a spring guide for guiding the center of a piston to be consistent with the center of the rear main spring while fixing and supporting the rear main spring.

It is still another object of the present invention to provide a linear compressor, which includes a spring guide whose surface is treated so as to prevent the spring guide from being abraded by friction with the rear main spring.

It is yet still another object of the present invention to provide a linear compressor, which has such a suction muffler installation structure as to make easier the coupling of a supporter piston and a suction muffler.

It is yet still another object of the present invention to provide a linear compressor, which includes one rear main spring to be fitted to the outer diameter of the suction muffler.

It is yet still another object of the present invention to provide a linear compressor, which can reduce the mass of the supporter piston and of the suction muffler by forming holes in the mounting portions of the supporter piston and suction muffler.

Technical Solution

The present invention provides a linear compressor, comprising: a stationary member including a cylinder for providing a space for compressing a refrigerant; a movable member linearly reciprocating with respect to the stationary member, and including a piston for compressing the refrigerant inside the cylinder and a supporter piston having a center coinciding with the center of the piston, connected to the piston and having a support portion extended in a radial direction of the piston; a plurality of front main springs positioned so as to be symmetrical with the center of the piston and the supporter piston, one ends of which being supported by the front surface of the support portion of the supporter piston and the other ends of which being supported by the stationary member; and one rear main spring having a center coinciding with the center of the piston and the supporter piston, one end of which being supported by the back surface of the supporter piston and the other end of which being supported by the stationary member.

In another aspect of the present invention, the piston and the supporter piston include steps engaged with each other at portions contacting with each other.

In another aspect of the present invention, the linear compressor further comprises a spring guide positioned between the supporter piston and the rear main spring, one end of the rear main spring being supported by the spring guide.

In another aspect of the present invention, the spring guide is fixed to the supporter piston so as to have a center coinciding with the center of the piston and the supporter piston.

In another aspect of the present invention, the spring guide includes a stepped portion for restraining one end of the rear main spring from moving in a transverse direction.

In another aspect of the present invention, at least the portion contacting with the rear main spring of the spring guide has a larger hardness than the hardness of the rear main spring.

In another aspect of the present invention, the supporter piston and the spring guider include guide holes corresponding to each other and guiding the supporter piston and the spring guide to be coupled to each other so that the center of the piston and the rear main spring can coincide with each other.

In another aspect of the present invention, the linear compressor further comprises a suction muffler positioned inside the rear main spring, and connected to at least any one of the piston and the supporter piston to introduce a refrigerant into the piston, the suction muffler passing through the spring guide.

In another aspect of the present invention, the stationary member further includes a back cover for supporting the other end of the rear main spring.

In another aspect of the present invention, the back cover includes either a bent portion or a projecting portion which is capable of fixing the rear main spring.

In another aspect of the present invention, the front main springs are provided in pairs at longitudinally and laterally symmetrical positions.

In another aspect of the present invention, the front main springs and the rear main spring have a natural frequency approximately coinciding with the resonant operating frequency of the piston.

In another aspect of the present invention, the stationary member further includes a stator cover for supporting one end of an outer stator, and the other end of the rear main spring is supported by the stator cover.

In another aspect of the present invention, the stator cover has a spring support portion corresponding to the number and position of the front main springs.

In another aspect of the present invention, the front main springs consist of two springs symmetrical to each other with respect to the center of the piston and the supporter piston.

In another aspect of the present invention, one rear main spring has a rigidity balanced with the rigidity of two front main springs.

In another aspect of the present invention, there is provided a linear compressor, comprising: a stationary member including a cylinder for providing a space for compressing a refrigerant; a movable member linearly reciprocating with respect to the stationary member, and including a piston for compressing the refrigerant inside the cylinder and a supporter piston fixed to the piston, having a center coinciding with the center of the piston and having a support portion extended in a radial direction of the piston; two front main springs symmetrical with the center of the piston and the supporter piston, one ends of which being supported by the front surface of the support portion of the supporter piston and the other ends of which being supported by the stationary member; and one or more rear main spring positioned at the opposite side of the piston, one end of which being supported by the back surface of the supporter piston.

In another aspect of the present invention, the supporter piston is fabricated of a metal having a lower density than an iron-based metal.

In another aspect of the present invention, the supporter piston is made of a non iron-based metal.

In another aspect of the present invention, the supporter piston is made of Al.

In another aspect of the present invention, the supporter piston is surface-treated in the region contacting with the front main springs.

In another aspect of the present invention, the supporter piston is surface-treated in the region contacting with the front main springs by either NIP coating or anodizing treatment.

In another aspect of the present invention, the linear compressor further comprises: a action muffler coupled to the rear of the supporter piston and providing a noise damping space of a refrigerant to be introduced into the piston; and a suction muffler guide groove formed on the piston, some part of the suction muffler being inserted therein.

In another aspect of the present invention, the linear compressor further comprises: a suction muffler coupled to the rear of the supporter piston and providing a noise damping space of a refrigerant to be introduced into the piston; and a suction muffler guide groove formed on the piston, some part of the suction muffler being inserted therein, and one end of the rear main spring is fitted to the outer diameter of the suction muffler.

In another aspect of the present invention, the suction muffler has a stepped portion provided at a portion coupled to the supporter piston, and the inner diameter of the rear main spring is fitted to the stepped portion to restrain transverse movement.

In another aspect of the present invention, the center of the rear main spring coincides with the center of the piston.

In another aspect of the present invention, the supporter piston and the suction muffler are fastened by a bolt.

In another aspect of the present invention, the supporter piston and the action muffler have at least one hole formed at a position except for the position fastened by the bolt.

Advantageous Effects

The linear compressor provided in the present invention can reduce parts production costs and simplify a part installation process by decreasing the number of main springs.

Furthermore, the linear compressor provided in the present invention further comprises one rear main spring and a spring guide for guiding the center of a piston to be consistent with the center of the rear main spring, thereby making easier the process for making the centers of the rear main spring and the piston coincide with each other Furthermore, the linear compressor provided in the present invention can prevent the generation of floating impurities in a refrigerant by the abrasion of the spring guide because the spring guide is surface-treated in the region frictioned by the rear main spring.

Furthermore, the linear compressor provided in the present invention can manage the operating conditions of the linear compressor by adjusting the rigidity of the rear main spring and accordingly selecting the rigidity of front main springs and the number thereof.

Furthermore, the linear compressor provided in the present invention can maintain a resonance condition even if the rigidity of the main springs is reduced because the supporter piston is made of a metal having a low density so that the mass of the entire driving unit can be reduced.

Furthermore, the linear compressor provided in the present invention can prevent the supporter piston from being abraded by movement of the front main springs because the portion at which the supporter piston and the front main springs are contacted with each other is surface-treated.

Furthermore, the linear compressor provided in the present invention can be easily coupled to the piston because the supporter piston is made of a non iron-based metal and thus receives no effect from the permanent magnet.

Furthermore, the linear compressor provided in the present invention easily determines a position of the supporter piston where the suction muffler is to be mounted because the supporter piston is provided with a groove for inserting a mounting portion of the suction muffler.

Furthermore, the linear compressor provided in the present invention can prevent the piston from deviating from the original path upon linear reciprocating movement and abraded by a friction with the cylinder because the centers of the piston and the rear main spring coincide with each other.

Furthermore, the linear compressor provided in the present invention can reduce the mass of the driving unit because the supporter piston and the mounting portion of the suction muffler are provided with holes.

MODE FOR THE INVENTION

Figure 3:
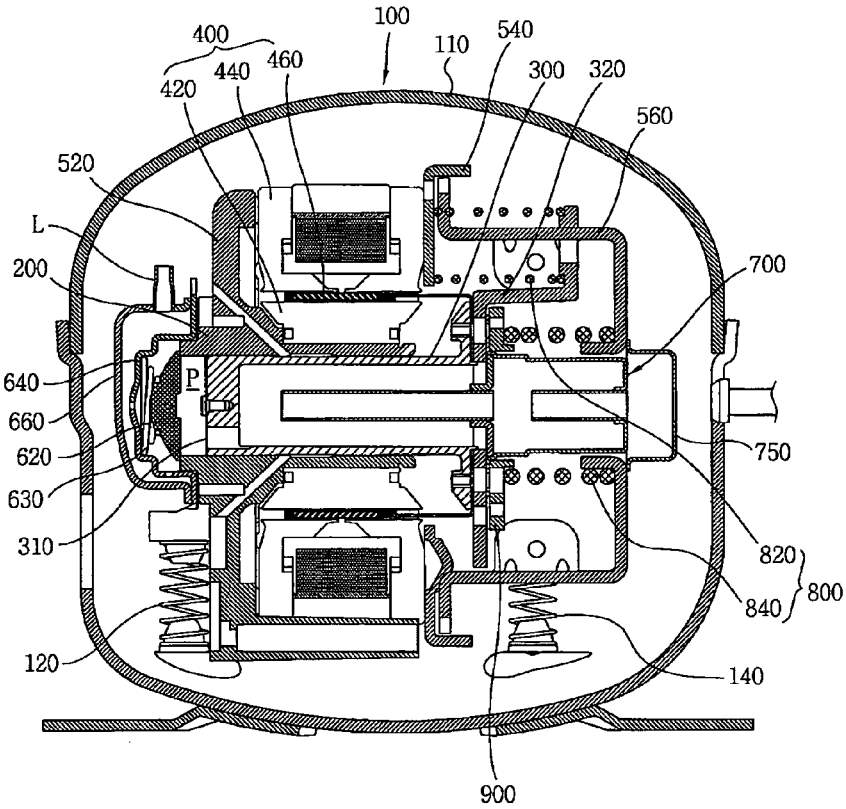
FIG. 3 is a view illustrating a cross section of a linear compressor according to one embodiment of the present invention.

Hereinafter, the present invention will be described in more detail with reference to the accompanying drawings. FIG. 3 is a view illustrating a cross section of a linear compressor according to one embodiment of the present invention. The linear compressor 110 has parts for compressing a refrigerant within a shell 110, which is a hermetic vessel, the inside of the shell 110 being filled with a low pressure refrigerant. The linear compressor 100 comprises a cylinder 200 providing a space for compressing a refrigerant inside the shell 100, a piston 300 linearly reciprocating inside the cylinder to compress the refrigerant, and a linear motor 400 including a permanent magnet 460, an inner stator 420 and an outer stator 440. When the permanent magnet is linearly reciprocated by a mutual electromagnetic force between the inner stator and the outer stator, the piston 300 connected to the permanent magnet 460 is linearly reciprocated along with the permanent magnet 460. The inner stator 420 is fixed to the outer periphery of the cylinder 200. Further, the outer stator 440 is fixed to a frame 520 by a stator cover 540. The frame 520 may be formed integral with the cylinder 200, or may be manufactured separately from the cylinder 200 to be coupled to the cylinder 200. In the embodiment as shown in FIG. 3, an example of integrally forming the frame 520 and the cylinder 200 is illustrated. The frame 520 and the stator cover 540 are coupled to each other, being fastened by a fastening member, such as a bolt, thereby fixing the outer stator 440 between the frame 520 and the stator cover 540.

A supporter piston 320 is connected to the rear of the piston 300. Both ends of front main springs 820 are supported by the supporter piston 320 and the stator cover 540. Further, both ends of a rear main spring 840 are supported by the supporter piston 320 and a back cover 560, and the back cover 560 is coupled to the rear of the stator cover 540. In order to prevent abrasion of the supporter piston 320 and increase the support strength of the rear main spring 840, the supporter piston 320 is provided with a spring guide 900. The spring guide 900 serves to guide the centers of the piston 300 and the rear main spring 840 so as to coincide with each other, as well as serving to support the rear main spring 840. At the rear of the piston 300, a suction muffler 700 is provided so as to reduce noise during the suction of refrigerant as the refrigerant is introduced into the piston through the suction muffler 700. The action muffler 700 is positioned inside the rear main spring 840.

The inside of the piston 300 is hollowed out to introduce the refrigerant introduced through the suction muffler 700 into a compression space P formed between the cylinder 200 and the piston 300 and compress it. A valve 310 is installed at the front end of the piston 300. The valve 310 is opened to introduce the refrigerant into the compression space P from the piston 300, and closes the front end of the piston 300 so as to avoid the refrigerant from being introduced again into the piston from the compression space P.

If the refrigerant is compressed by the piston 300 in the compression space P at a pressure higher than a predetermined level, a discharge valve 620 positioned on the front end of the cylinder 200 is opened. The discharge valve 620 is installed so as to be elastically supported by a spiral discharge valve spring inside a support cap 640 fixed to one end of the cylinder 200. The compressed refrigerant of high pressure is discharged into a discharge cap 660 through a hole formed on the support cap 640, and then discharged out of the linear compressor 100 through a loop pipe L thus to circulate the refrigerating cycle.

Each of the parts of the above-described linear compressor 100 is supported in an assembled state by a front support spring 120 and a rear support spring 140, and is spaced apart from the bottom of the shell 110. Since the parts are not in direct contact with the bottom of the shell 110, vibrations generated from each of the parts are no directly transmitted to the shell 110. Therefore, noise generated from the vibration transmitted to the outside of the shell 110 and the vibration of the shell 110 can be r educed.

Figure 4:
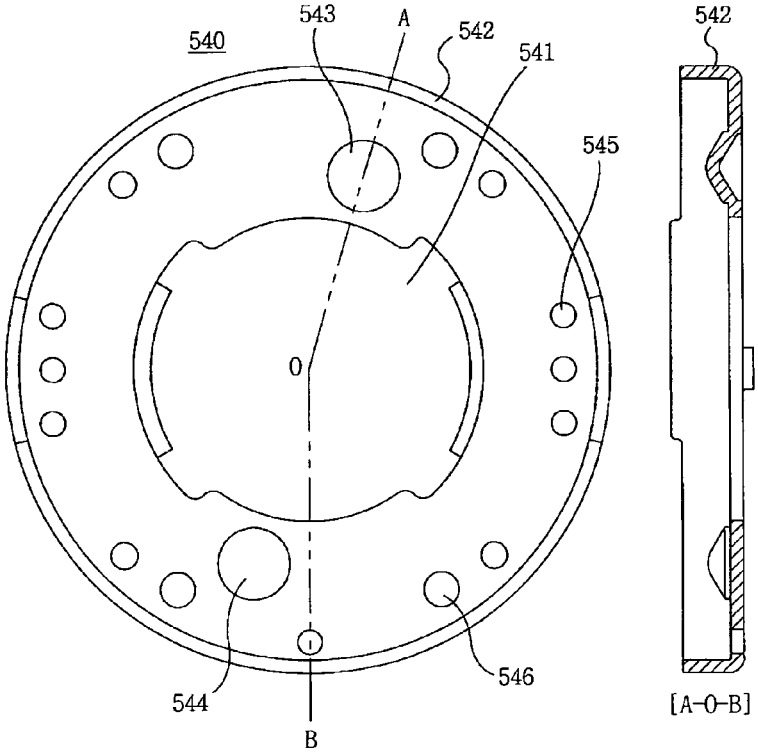
FIG. 4 is a view illustrating a stator cover of the linear compressor according to one embodiment of the present invention.

FIG. 4 is a view illustrating a stator cover of the linear compressor according to one embodiment of the present invention. The stator cover 540 is approximately circular, and has a hole 541 formed therein so that an assembly in which the piston 300 (shown in FIG. 3), permanent magnet 460 (shown in FIG. 3), supporter piston 320 (shown in FIG. 3) and muffler 700 (shown in FIG. 3) are coupled can penetrate through the stator cover 540 and linearly reciprocate. Further, a bent portion 542 is formed along the outer periphery of the stator cover 540. The bent portion 542 increases the support strength of the stator cover 540.

The center of the stator cover 540 coincides with the center of the piston, and two front main spring support projections 543 and 544 are formed at positions symmetrical to these centers. The front main spring support projections 543 and 544 support both ends of the front main springs along with the supporter piston 320 (shown in FIG. 3). The front main spring support projections 543 and 544 support the front end (the other end) of the front main springs, and the supporter piston 320 (shown in FIG. 3) support the rear end (one end) of the front main spring.

Besides, a plurality of bolt holes 545 for fastening the back cover 560 (shown in FIG. 3) by bolts and a plurality of bolt holes 546 for fastening the frame 520 by bolts are formed at both sides of the stator cover 540.

Figure 5:
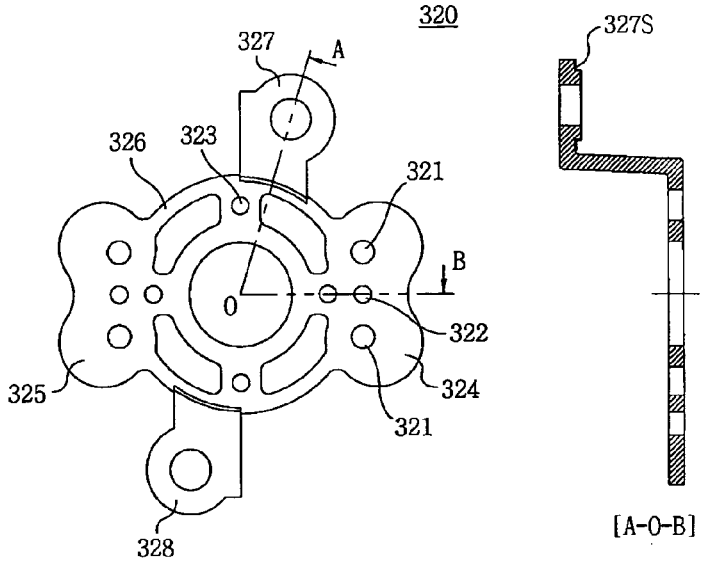
FIG. 5 is a view illustrating one example of a supporter piston provided in the linear compressor of the present invention.

FIG. 5 is a view illustrating one example of a supporter piston provided in the linear compressor of the present invention. The supporter piston 320 is coupled to the rear of the piston (shown in FIG. 3), and receives a force from the main springs 820 and 840 and transmits it to the piston 300 (shown in FIG. 3) so that the piston 300 (shown in FIG. 3) can linearly reciprocate under a resonance condition. The supporter piston 320 is provided with a plurality of bolt holes 323 to be coupled to the piston 300 (shown in FIG. 3).

The supporter piston 320 is installed such that its center is consistent with the center of the piston 300 (shown in FIG. 3). Preferably, a step is formed on the rear end of the piston 300 (shown in FIG. 3) so as to easily make the centers of the supporter piston 320 and the piston 300 (shown in FIG. 3) coincide with each other. The supporter piston 320 has aril a shape in which support portions 327 and 328 and guide portions 324 and 325 are formed at the top, bottom, left, and right, respectively, of an approximately circular body 326. The support portions 327 and 328 are formed at positions symmetrical with respect to the center of the supporter piston 320. The support portions 327 and 328 are formed at the top and bottom, respectively, of the body 326, and bent twice from the body 326. That is, the support portions 327 and 328 are bent once rearward from the body 326 and then bent upward or downward, respectively. The rear end (one end) of the front main springs 820 (shown in FIG. 3) is supported on the front of the support portions 327 and 328 of the supporter piston 320.

Figure 1:
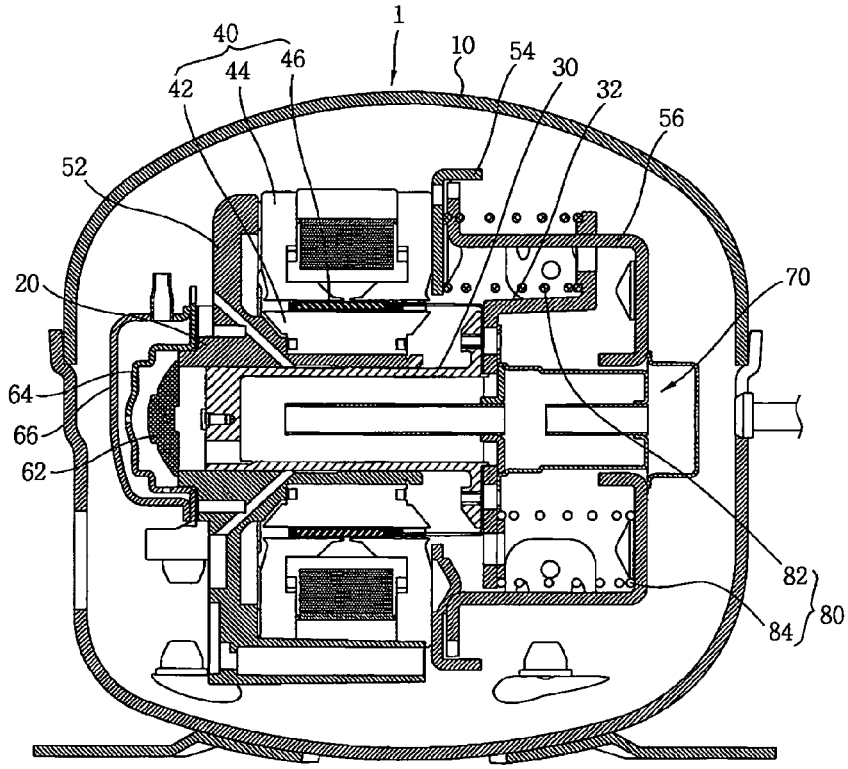
FIG. 1 is a view illustrating one example of a conventional linear compressor.
Figure 2:
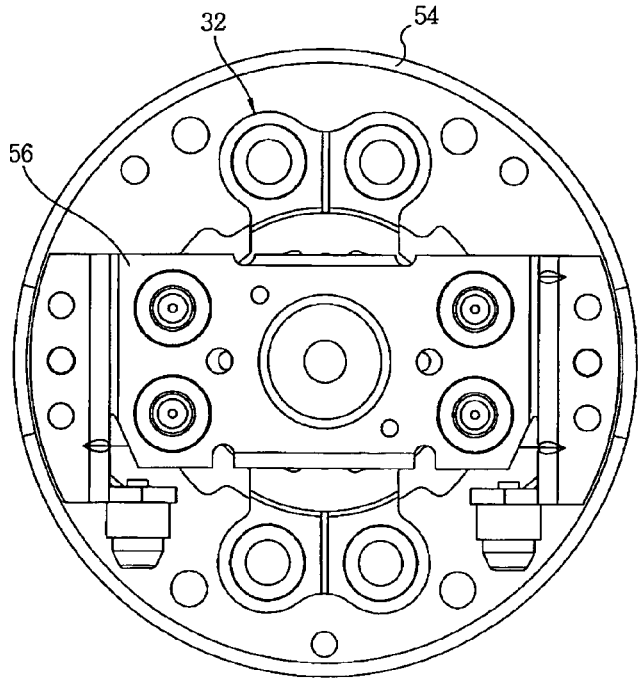
FIG. 2 is a view illustrating the linear compressor of FIG. 1 as viewed from the back cover.

Further, the guide portions 324 and 325 are formed at the left and right of the body 326 of the supporter piston 320. Guide holes 321 for making the center of the spring guide 900 (shown in FIG. 3) consistent with the center of the piston 300 (shown in FIG. 2) and bolt holes 322 for fastening the spring guide 900 by bolts are formed at the guide portions 324 and 325. Besides, a muffler 700 (shown in FIG. 3) is fixed to the rear of the supporter piston 320.

The number of the front main springs 820 (shown in FIG. 3) is decreased to two and the number of the rear main spring 840 (shown in FIG. 3) is decreased to one, thereby decreasing the spring rigidity of the resonance system on the whole. Further, if the number of the front main springs 820 (shown in FIG. 3) and the rear main spring 840 (shown in FIG. 3) is decreased, respectively, the production cost of the main springs can be cut down.

At this time, if the rigidity of the front main springs 820 (shown in FIG. 3) and the rear main spring 840 (shown in FIG. 3) becomes smaller, the mass of the driving unit including the piston 300 (shown in FIG. 3), supporter piston 320 (shown in FIG. 3) and permanent magnet 460 (shown in FIG. 3) should be smaller to thus drive the driving unit under a resonance condition. Therefore, the supporter piston 320 is made of a non iron-based metal having a lower density than that of an iron-based metal, rather than being made of an iron-based metal. As a result, the mass of the driving unit can be reduced, and accordingly can be driven at a resonance frequency according to the decreased rigidity of the front main springs 820 (shown in FIG. 3) and the rear main spring 840 (shown in FIG. 3). For example, if the supporter piston 320 is made of a nonmagnetic metal, such as aluminum, even if the piston 300 (shown in FIG. 3) is made of a metal, the supporter piston 320 has no effect from the permanent magnet 300 (shown in FIG. 3). Therefore, the piston 300 (shown in FIG. 3) and the supporter piston 320 can be coupled to each other more easily.

If the supporter piston 320 is made of a non iron-based metal having a low density, this offers the advantage that the resonance condition is satisfied and the supporter piston 320 can be easily coupled to the piston 300 (shown in FIG. 3). forever, the portion contacting with the front main springs 820 (shown in FIG. 3) may be easily abraded by a friction with the front main springs 820 (shown in FIG. 3) during driving. When the supporter piston 320 is abraded, abraded debris may damage the parts existing on the refrigerating cycle while floating in the refrigerant and circulating the refrigerating cycle. Therefore, surface treatment is performed on the portion where the supporter piston 320 and the front main springs 820 (shown in FIG. 3) are in contact with each other. By carrying out NIP mating or anodizing treatment, the surface hardness of the portion where the supporter piston 320 and the front main springs 820 (shown in FIG. 3) are in contact with each other is made larger at least than the hardness of the front main springs 820 (shown in FIG. 3). By this constriction, it is possible to prevent the generation of debris by the supporter piston 320 being abraded by the front main springs 820 (shown in FIG. 3).

Figure 6:
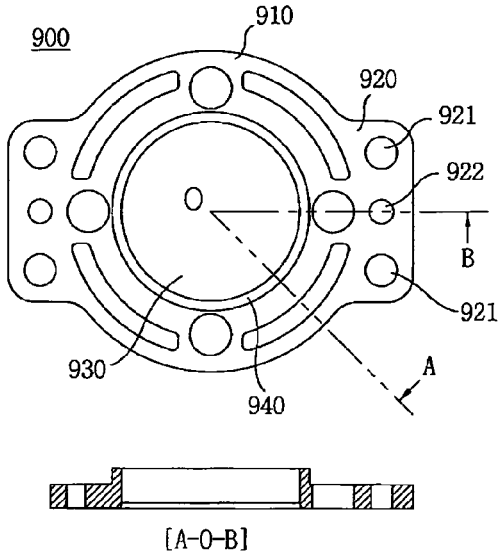
FIG. 6 is a view illustrating one example of a spring guide provided in the linear compressor of the present invention.

FIG. 6 is a view illustrating one example of a spring guide provided in the linear compressor of the present invention. The spring guide 900 comprises an approximately circular body 910 and guide portions 920 at both sides of the body. The spring guide 900 supports the front end (one end) of the rear main spring 840 (shown in FIG. 3). A hole 930 through which the muffler 700 passes is formed at the center of the spring guide 900, and a support portion 940 projected rearward is formed along the outer periphery of the hole 930. The support portion 940 is a portion to which the rear main spring 840 (shown in FIG. 3) is fitted. Thus, the rear main spring 840 (shown in FIG. 3) comes in contact with the circumference of the hole 930 and the support portion 940 in the body 910. The region contacting with the rear main spring 840 (shown in FIG. 3) may be abraded by the rear main spring 840 (shown in FIG. 3) by repetitive compression and restoration of the rear main spring 840 (shown in FIG. 3). Abraded debris or the like of the spring guide 900 may damage the apparatus while passing through the refrigerating cycle including the linear compressor 100 (shown in FIG. 3) along with a refrigerant. Therefore, surface treatment is performed on the portion where the spring guide 900 is in contact with the rear main spring 840 (shown in FIG. 3) to thus prevent abrasion of the rear main spring 840 (shown in FIG. 3). Preferably, the surface hardness of the spring guide 900 is larger than the hardness of the rear main spring 840 (shown in FIG. 3). Consequently, like the supporter piston 320 (shown in FIG. 5), the spring guide 900, too, undergoes surface treatment, such as NIP coating or anodizing.

Additionally, guide holes 921 and bolt holes 922 are formed at the guide portion 920 of the spring guider 900. The guide holes 921 are formed at positions corresponding to the guide holes 321 of the supporter piston 320 (shown in FIG. 5). by making guide holes 322 (shown in FIG. 5) of the supporter piston (shown in FIG. 5) consistent with the guide holes 921 of the spring guide 900, the center of the piston 300 (shown in FIG. 3) and the center of the main spring 840 (shown in FIG. 3) supported by the spring guide 900 can be made consistent with each other.

Figure 7:
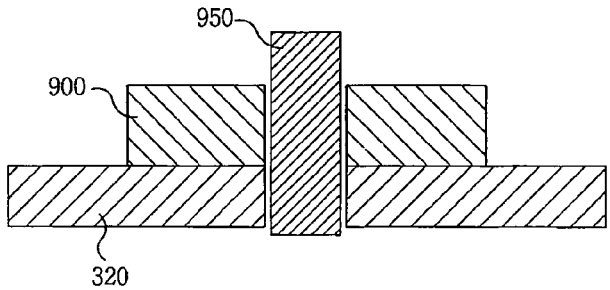
FIG. 7 is a view schematically illustrating a method for fastening the supporter piston and spring guide of the linear compressor according to one example of the present invention.

FIG. 7 is a view schematically illustrating a method for fastening the supporter piston and spring guide of the linear compressor according to one example of the present invention. The supporter piston 320 is fastened to the piston 300 (shown in FIG. 3) by a bolt. The supporter piston 320 and the piston 300 are coupled when fastened in such a manner that their centers are consistent with each other. Part of the rear of the muffler 700 (shown in FIG. 3) is coupled to the rear of the supporter piston 320, and then the supporter piston 320 and the spring guide 900 are coupled to each other. When coupling the spring guide 900, in order to make it easier to make the centers of the spring guide 900 and the supporter piston 320 consistent with each other, guide holes 321 (shown in FIGS. 5) and 921 (shown in FIG. 6) and bolt holes 322 (shown in FIGS. 5) and 922 (shown in FIG. 6) are formed at the supporter piston 320 and the spring guide 900, respectively.

As schematically shown in FIG. 7, guide pins 950 are inserted into the guide holes 321 (shown in FIG. 5) of the supporter piston 320 coupled to the piston 300 (shown in FIG. 3). Next, the guide pins 950 and the guide holes 921 of the spring guide 900 are made consistent with each other, to thus guide the spring guide 900 to an appropriate position. Next, bolts passing through bolt holes 327 (shown in FIGS. 5) and 922 (shown in FIG. 6) of the support piston 320 and spring guide 900 are fastened, thereby coupling the supporter piston 320 and the spring guide 900. As the installation piston of the spring guide 900 is guided by the guide pins 950, the centers of the supporter piston 320 and the spring guide 900 can be made consistent with each other more easily. Further, the piston 300 (shown in FIG. 3) and the supporter piston 320 are designed such that their centers are consistent with each other, and the spring guide 900 and the rear main spring 840 (shown in FIG. 3) are designed such that their centers are consistent with each other. Therefore, by making the centers of the supporter piston 320 and the spring guide 900 consistent with each other, the centers of the piston 300 (shown in FIG. 3) and the rear main spring 840 (shown in FIG. 3) can be made consistent with each other. The centers of the piston 300 (shown in FIG. 3) and the rear main spring 840 (shown in FIG. 3) should be consistent with each other to enable linear reciprocation of the piston 300 (shown in FIG. 3).

Figure 8:
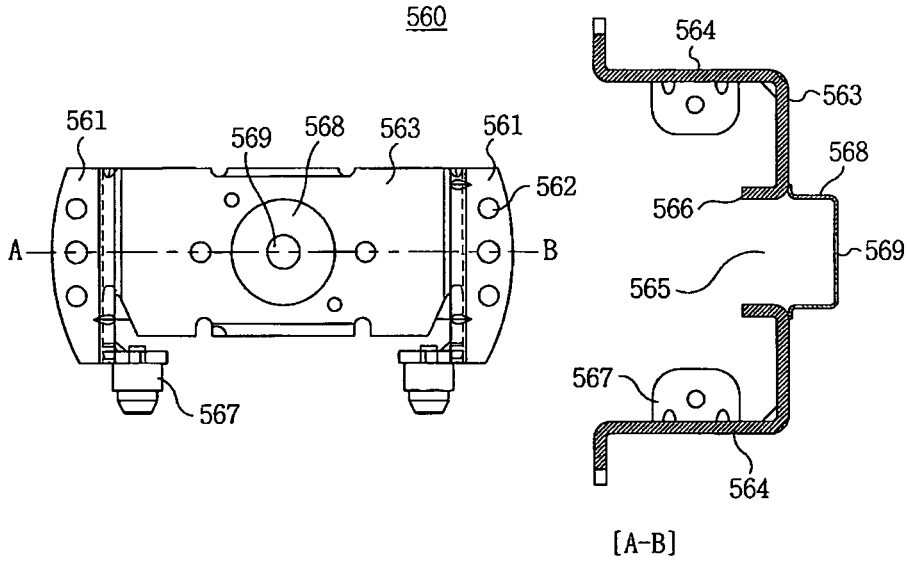
FIG. 8 is a view illustrating one example of a back cover provided in the linear compressor of the present invention.

FIG. 8 is a view illustrating one example of a back cover provided in the linear compressor of the present invention. The back cover 560 is fastened by bolts to the rear of the stator cover 540 (shown in FIG. 3). Both side portions of the back cover 560 are bent and come into contact with the stator cover 540 (shown in FIG. 3), and these contact portions 561 are provided with bolt holes 562 for coupling to the stator cover 540 (shown in FIG. 3). Further, the back cover 560 is provided with a rear surface 563 positioned spaced a predetermined gap apart from the stator cover 540 (shown in FIG. 3) and side surfaces 564 for connecting the contact portions 561 and the rear surface 563. At the center of the rear surface 563, a hole 565 through which part of the muffler 700 (shown in FIG. 3) passes through and a main spring support portion 566 bent forward along the outer periphery of the hole 565 and fixing the rear main spring 840 (shown in FIG. 3) are formed. The inner periphery of the rear main spring 840 (shown in FIG. 3) is fitted to the outer periphery of the main spring support portion 566. Further, a support spring support portion 567 for supporting one end of the rear main spring 140 (shown in FIG. 3) is formed under the side surfaces 564. Support springs 120 and 140 (shown in FIG. 3) support a refrigerant compression assembly between the shell 110 (shown in FIG. 3) and the support spring support portion 567, so that the refrigerant compression assembly of the linear compressor is spaced apart from the bottom of the shell 110 (shown in FIG. 3). As the refrigerant compression assembly is not in direct contact with the bottom of the shell 110 because of the support springs 120 and 140 (shown in FIG. 3), noise caused by vibration transmitted to the shell 110 (shown in FIG. 3) can be reduced during the operation of the refrigerant compression assembly. Further, a muffler cover 569 preventing rearward movement of the muffler 700 (shown in FIG. 3) and having a through hole 569 through which a refrigerant inlet tube for letting in a refrigerant into the muffler 700 (shown in FIG. 3) penetrates is attached to the rear of the hole 565 of the back cover 560.

Figure 9:
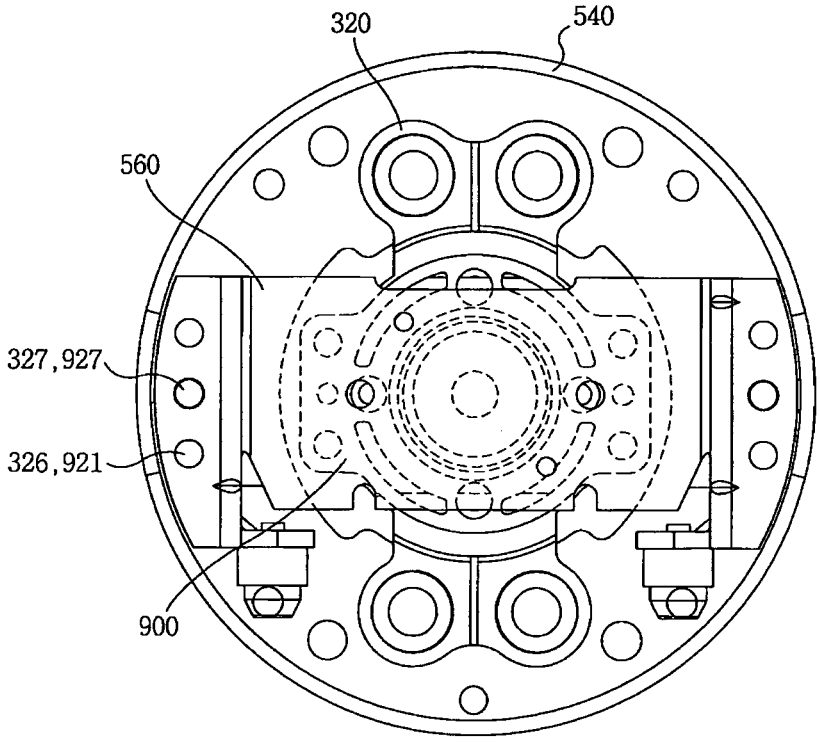
FIG. 9 is a view, as viewed from the rear, of one example in which a stator cover, the supporter piston, the spring guide and the back cover provided in the linear compressor of the present invention are coupled.

FIG. 9 is a view, as viewed from the rear, of one example in which a stator cover, the supporter piston, the spring guide and the back cover provided in the linear compressor of the present invention are coupled. As shown in FIG. 9, the guide holes 321 and 921 and the bolt holes 322 and 922 formed on the supporter piston 320 and the spring guider 900 are consistent with each other. Further, the center of the stator cover 540, the center of the body 326 of the supporter piston 320, the center of the body 910 of the spring guide 900, the center of the hole 565 of the back cover 560, and the center of the main spring support portion 567 of the back cover 560 are all consistent with each other.

Moreover, as showon in FIG. 5, the support portions 327 and 328 of the supporter piston 320 may be formed at positions symmetrical with respect to the piston 300 (shown in FIG. 3) so as to support two front main springs 820. Otherwise, as shown in FIG. 9, the support portions 327 and 328 of the supporter piston 320 may be formed at positions longitudinally symmetrical to each other so as to support four front main springs 820. By this, when the rigidity of the rear main spring 840 is changed according to a resonance operating condition, the number of the front main springs 820 can be varied according to which is more advantageous between the use of two front main springs 820 and the use of four front main springs 840.

Figure 10:
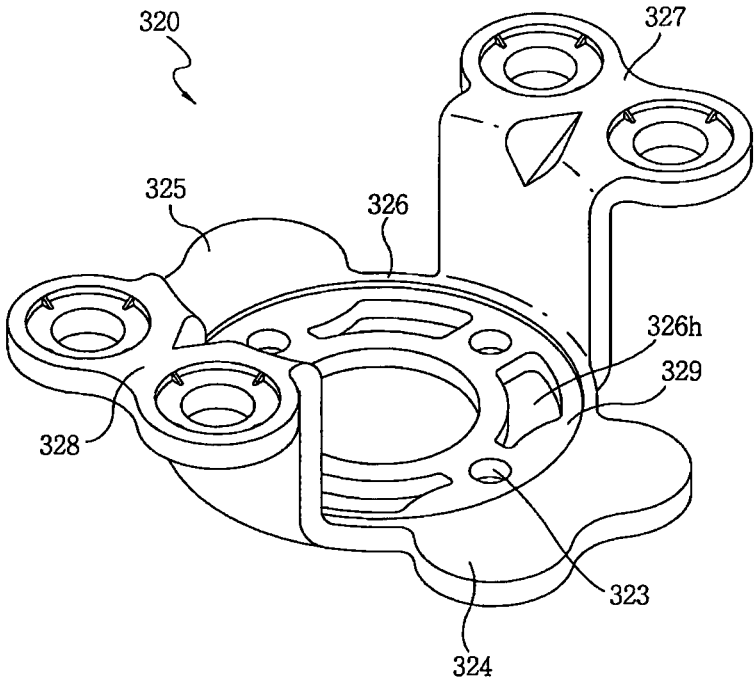
FIG. 10 is a view illustrating one example of the supporter piston provided in the linear compressor according to one embodiment of the present invention.
Figure 11:
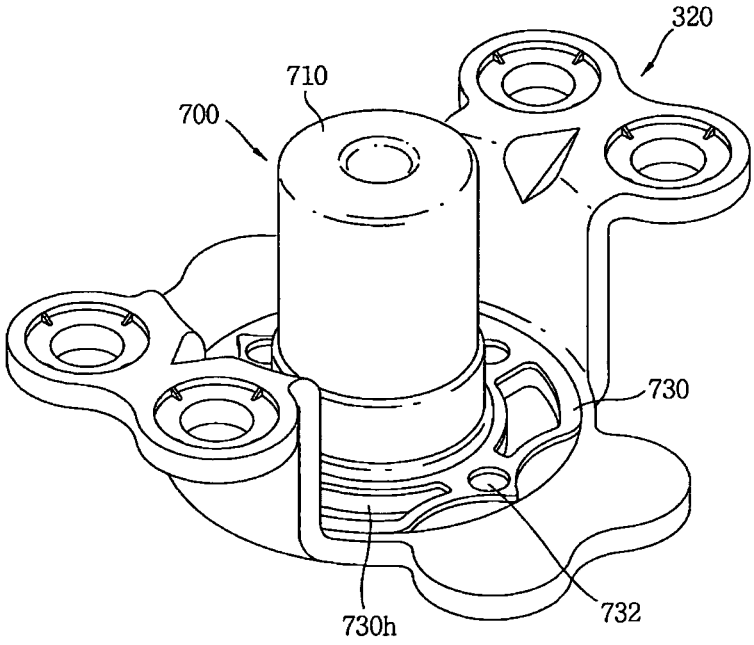
FIG. 11 is a view schematically illustrating a method for coupling the supporter piston and muffler provided in the linear compressor of the present invention.

FIG. 10 is a view illustrating one example of the supporter piston provided in the linear compressor according to one embodiment of the present invention. FIG. 11 is a view schematically illustrating a method for coupling the supporter piston and muffler provided in the linear compressor of the present invention.

The supporter piston 320 is coupled to the rear of the piston 300, and receives a force from the main springs 820 and 840 and transmits it to the piston 300 so that the piston 300 can linearly reciprocate under a resonance condition. The supporter piston 320 is provided with a plurality of bolt holes 323 to be coupled to the piston 300 and the muffler 700.

The supporter piston 320 is installed such that its center is consistent with the center of the piston 300.

Preferably, a step is formed on the rear end of the piston 300 so as to easily make the centers of the supporter piston 320 and the piston 300 coincide with each other. The supporter piston 320 has such a shape in which support portions 327 and 328 and guide portions 324 and 325 are formed at the top and bottom, respectively, of an approximately circular body 326. The support portions 327 and 328 are formed at positions symmetrical with respect to the center of the supporter piston 320. The support portions 327 and 328 are formed at the top and bottom, respectively, of the body 326, and bent twice from the body 326. That is, the support portions 327 and 328 are bent once rearward from the body 326 and then bent upward or downward, respectively. The rear end (one end) of the front main springs 820 is supported on the front of the support portions 327 and 328 of the supporter piston 320.

Regarding the main springs applying a restoration force to the supporter piston 320 to operate the piston 300 coupled to the supporter piston 320 under the resonance condition, the number of the front main springs 820 is decreased to two and the number of the rear main spring 840 is decreased to one, thereby decreasing the spring rigidity of the resonance system on the whole. Further, if the number of the front main springs 820 and the rear main spring 840 is decreased, respectively, the production cost of the main springs can be cut down.

At this time, if the rigidity of the front main springs 820 (shown in FIG. 3) and the r ear main spring 840 becomes smaller, the mass of the driving unit including the piston 300, supporter piston 320 and permanent magnet 460 should be smaller to thus drive the driving unit under a resonance condition. Therefore, the supporter piston 320 is made of a non iron-based metal having a lower density than that of an iron-based metal, rather than being made of an iron-based metal. As a result, the mass of the driving unit can be reduced, and accordingly can be driven at a resonance frequency according to the decreased rigidity of the front main springs 820 and the rear main spring 840. For example, if the supporter piston 320 is made of a metal, such as aluminum, even if the piston 300 is made of a metal, the supporter piston 320 has no effect from the permanent magnet 300. Therefore, the piston 300 and the supporter piston 320 can be coupled to each other more easily.

If the supporter piston 320 is made of a non iron-based metal having a low density, this offers the advantage that the resonance condition is satisfied and the supporter piston 320 can be easily coupled to the piston 300. However, the portion contacting with the front main springs 820 may be easily abraded by a friction with the front main springs 820 during driving. When the supporter piston 320 is abraded, abraded debris may damage the parts existing on the refrigerating cycle while floating in the refrigerant and circulating the refrigerating cycle. Therefore, surface treatment is performed on the portion where the supporter piston 320 and the front main springs 820 are in contact with each other. By carrying out NIP coating or anodizing treatment, the surface hardness of the portion where the supporter piston 320 and the front main springs 820 are in context with each other is made larger at least than the hardness of the front main springs 820. By this construction, it is possible to prevent the generation of debris by the supporter piston 320 being abraded by the front main springs 820.

Further, a suction muffler 700 is mounted at the rear of the supporter piston 320, and a refrigerant to be compressed is sucked into the piston 300 through the suction muffler 700 in a noise reduced state. The suction muffler 700 is provided with a noise chamber 710, which is a circular space for redwing noise, and a mounting portion 730 formed at one end of the noise chamber 710, i.e., an end portion contacting with the supporter piston 320 at the front side of the suction muffler 700. The mounting portion 730 is formed in an approximately circular shape, extended in a radial direction from one end of the noise chamber 710.

A suction muffler guide groove 329 corresponding to the shape of the mounting portion 730 of the suction muffler 700 and accommodating the mounting portion 730 is formed at the body 326 of the supporter piston 320. The suction muffler 700 is fastened to the supporter piston 320 by bolts, with the mounting portion 730 of the suction muffler 700 being accommodated in the suction muffle guide groove 329. Therefore, it is possible to prevent bolt holes 323 of the supporter piston 320 and bolt holes 732 of the mounting portion 730 of the suction muffler 700 from longitudinally or laterally deviating from each other by a difference in size between the bolt holes 732 formed on the mounting portion 730 of the suction muffler 700 and the screw portions of the bolts and a difference in size between the bolt holes 323 of the supporter piston 320 and the bolt holes 732 of the mounting portion 730 of the suction muffler 700. As the center of the suction muffler 700 and the center of the supporter piston 320 coincide with each other without any deviation therebetween, the center of the piston 300, which coincides with the center of the supporter piston 320, also coincides with the center of the suction muffler 700.

Further, the rear main spring 840 is mounted to the outer diameter of the suction muffler 700. The inner diameter of the rear main spring 840 is fitted to the outer diameter of the section muffler 700. Therefore, the center of the suction muffler 700 coincides with the center of the rear main spring 840. Further, the suction muffler 700 is provided with a stepped portion 720 between the noise chamber 710 and the mounting portion 730, which is stepped from the noise chamber 710 and the mounting portion 730. Preferably, the rear main spring 840 is fitted to the stepped portion 720, and supported by the stepped portion 720 and the mounting portion 730.

Moreover, holes **326*h* and 730*h* are formed at the supporter piston 320 and the mounting portion 730 of the suction muffler 700, respectively. The holes 326*h* and 730*h* allow the refrigerant filled in the shell 110 (shown in FIG. 3) to communicate with each other forward and rearward of the holes 326*h* and 730*h* when the driving unit, including the piston 300 (shown in FIG. 3), supporter piston 320, and suction muffler 700, is driven, thereby reducing the resistance during driving caused by the refrigerant. Besides, the mass of the driving unit, including the piston 300, supporter piston 320, permanent magnet 460, and suction muffler 700, can be reduced by forming the holes 326*h* and 730*h*. Accordingly, it is possible for the piston 300 to linearly reciprocate while maintaining a resonance condition with the rear main spring 840**, the number of which is decreased to one, and the front main springs 820, the number and rigidity of which are decreased according to the decrease in rigidity caused by the decrease in the number of the rear main spring 840. By this construction, the production costs of the main springs can be cut down since the number of the main springs is decrease and the rigidity is decreased.

The invention claimed is:

1. A linear compressor, comprising:

a stationary member including a cylinder for providing a space for compressing a refrigerant wherein an inner stator fixed to the outer periphery of the cylinder, a frame formed integral with the cylinder or coupled to the cylinder, a stator cover fastened to the frame for fixing an outer stator between the frame and the stator cover, and a back cover fastened to the rear of the stator cover;

a movable member linearly reciprocating with respect to the stationary member, and including a piston for compressing the refrigerant inside the cylinder, a permanent magnet connected to the piston to be linearly reciprocated along with the piston between the inner stator and the outer stator and a supporter piston having a center coinciding with the center of the piston, connected to the rear of the piston and having support portions extended in a radial direction from the center and guide portions extended in a different radial direction from the center, guide holes and bolt holes being formed at the guide portions of the supporter piston;

a plurality of front main springs positioned so as to be symmetrical with the center of the piston and the supporter piston, one end of which being supported by the front surface of the support portion of the supporter piston and the other ends of which being supported by the rear of the stator cover;

a single rear main spring having a center coinciding with the center of the piston and the supporter piston, one end of which being supported by the back surface of the supporter piston and the other end of which being supported by the back cover; and a spring guide positioned between the supporter piston and the single rear main spring, the one end of the rear main spring being supported by the spring guide, the spring guide including an approximately circular body and guide portions at both sides of the body, and guide holes and bolt holes being formed at the guide portions of the spring guide, wherein the spring guide is bolt-fastened at the bolt holes of the supporter piston and spring guide in the state that the guide holes of the supporter piston made consistent with the guide holes of the spring guide by inserting guide pins through the guide holes of the supporter piston and the spring guide.

2. The linear compressor of claim 1, wherein the piston and the supporter piston include steps engaged with each other at portions contacting with each other.

3. The linear compressor of claim 1, wherein the spring guide includes a stepped portion for restraining the one end of the single rear main spring from moving in a transverse direction.

4. The linear compressor of claim 3, wherein at least the portion contacting with the single rear main spring of the spring guide has a larger hardness than the hardness of the single rear main spring.

5. The linear compressor of claim 1, further comprising a suction muffler positioned inside the single rear main spring, and connected to at least any one of the piston and the supporter piston to introduce a refrigerant into the piston, wherein a hole is provided at the body of the spring guide so that the suction muffler may pass through the hole of the spring guide.

6. The linear compressor of claim 1, wherein the back cover includes either a bent portion or a projecting portion which is capable of fixing the single rear main spring.

7. The linear compressor of claim 1, wherein the front main springs are provided in pairs at longitudinally and laterally symmetrical positions with the center of the piston and the supporter piston.

8. The linear compressor of claim 1, wherein the stator cover has a spring support portion corresponding to the number and position of the front main springs.

9. The linear compressor of claim 1, wherein the front main springs consist of two springs symmetrical to each other with respect to the center of the piston and the supporter piston.

10. The linear compressor of claim 9, wherein the single rear main spring has a rigidity balanced with the rigidity of two front main springs.

11. The linear compressor of claim 1, wherein the supporter piston is made of nonferrous and non-magnetic metal.

12. The linear compressor of claim 11, wherein the supporter piston is made of Al-based metal.

13. The linear compressor of claim 11, wherein the supporter piston is surface-treated in the region contacting with the front main springs.

14. The linear compressor of claim 13, wherein the supporter piston is surface-treated in the region contacting with the front main springs by either NIP coating or anodizing treatment.

15. The linear compressor of claim 1, wherein the linear compressor further comprises: a suction muffler coupled to the rear of the supporter piston and providing a noise damping space for a refrigerant to be introduced into the piston; and a suction muffler guide groove formed on the supporter piston, some part of the suction muffler being inserted therein.

16. The linear compressor of claim 15, wherein the supporter piston and the suction muffler are fastened by a bolt.

17. The linear compressor of claim 16, wherein the supporter piston and the suction muffler have at least one hole formed at a position except for the position fastened by the bolt.

18. The linear compressor of claim 1, wherein the linear compressor further comprises: a suction muffler coupled to the rear of the supporter piston and providing a noise damping space of a refrigerant to be introduced into the piston; and a suction muffler guide groove formed on the supporter piston, some part of the suction muffler being inserted therein, and one end of the single rear main spring is fitted to the outer diameter of the suction muffler.

19. A linear compressor, comprising:

a stationary member including a cylinder for providing a space for compressing a refrigerant;

a movable member linearly reciprocating with respect to the stationary member, and including a piston for compressing the refrigerant inside the cylinder and a supporter piston having a center coinciding with the center of the piston, connected to the rear of the piston and having a support portion extended in a radial direction from the piston;

a plurality of front main springs positioned so as to be symmetrical with the center of the piston and the supporter piston, one end of which being supported by the front surface of the support portion of the supporter piston and the other ends of which being supported by the stationery member; and a single rear main spring having a center coinciding with the center of the piston and the supporter piston, one end of which being supported by the back surface of the supporter piston and the other end of which being supported by the stationery member, wherein the front main springs and the single rear main spring have a natural frequency approximately coinciding with the resonant operating frequency of the piston.

* * * * *